United States Patent [19]

Kawashima

[11] Patent Number: 4,516,991

[45] Date of Patent: May 14, 1985

[54] AIR CLEANING APPARATUS

[75] Inventor: Ryozo Kawashima, Kanagawa, Japan

[73] Assignee: Nihon Electric Co. Ltd., Tokyo, Japan

[21] Appl. No.: 487,952

[22] Filed: Apr. 25, 1983

[30] Foreign Application Priority Data

Dec. 30, 1982 [JP] Japan ..... 57-228284
Feb. 18, 1983 [JP] Japan ..... 58-24831

[51] Int. Cl.[3] ..... B03C 3/08; B03C 3/32

[52] U.S. Cl. ..... 55/124; 55/137; 55/138; 55/139; 55/145; 55/147; 55/155

[58] Field of Search ..... 55/124, 126, 136–139, 55/143, 145, 147, 150, 153, 154, 155

[56] References Cited

U.S. PATENT DOCUMENTS

| | | | |
|---|---|---|---|
| 2,279,583 | 4/1942 | Slayter | 55/124 |
| 2,873,000 | 2/1959 | Elam | 55/139 |
| 3,740,926 | 6/1973 | Duval | 55/139 |
| 3,745,750 | 7/1973 | Arff | 55/124 |
| 3,747,300 | 7/1973 | Knudson | 55/138 |
| 3,816,980 | 6/1974 | Schwab | 55/147 |
| 3,988,131 | 10/1976 | Kanazawa et al. | 55/124 |
| 4,022,594 | 5/1977 | Baysek | 55/139 |
| 4,102,654 | 7/1978 | Pellin | 55/126 |
| 4,133,652 | 1/1979 | Ishikawa et al. | 55/126 |
| 4,227,894 | 10/1980 | Proynoff | 55/126 |
| 4,231,766 | 11/1980 | Spurgin | 55/138 |
| 4,253,852 | 3/1981 | Adams | 55/136 |
| 4,259,093 | 3/1981 | Vlastos et al. | 55/137 |
| 4,261,712 | 4/1981 | Kinkade | 55/139 |

FOREIGN PATENT DOCUMENTS

| | | | |
|---|---|---|---|
| 717705 | 11/1954 | United Kingdom | 55/138 |

*Primary Examiner*—David L. Lacey
*Attorney, Agent, or Firm*—Michael J. Striker

[57] ABSTRACT

An air cleaning apparatus includes a plurality of dust collecting electrodes alternately arranged with panel electrodes and spaced from each other at predetermined intervals to form air flow passages. Voltage is applied by a voltage source between the panel electrodes and the dust collecting electrodes and between ionizing wires, provided in the apparatus, and the dust collecting panel electrodes. The intervals between the panel electrodes and the dust collecting electrodes are selected to maintain a predetermined potential gradient in response to the value of the voltage applied between the panel electrodes and the dust collecting electrodes, whereby corona discharges are generated between the dust collecting electrodes and the ionizing wires to produce air streams. The dust collecting electrodes and the corresponding panel electrodes are coated with an ozone decomposition accelerating noble metal plating layer.

2 Claims, 9 Drawing Figures

AIR CLEANING APPARATUS

BACKGROUND OF THE INVENTION

This invention relates to an air cleaning apparatus. A conventional air cleaning apparatus disclosed, for example, in Japanese Pat. No. 996,051 is known. More particularly, a conventional air cleaner has, as shown in FIG. 1, a plurality of dust collecting electrodes 1 formed of aluminum, corresponding electrodes 2 alternately arranged between dust collecting electrodes 1 at intervals of approx. 10 mm to form air flow passages, and ionizing wires 3 installed outside of the electrodes at a distance r from the line connecting the ends of the respective electrodes 1 on extension lines extended from the respective electrodes 2. The distance r is approx. 20 mm. The wires 3 and each electrode 2 are commonly connected as positive polarity, the electrodes 1 being of negative polarity, and a voltage of approx. 15 kV is applied from a power source 4 between the electrodes and the wires. A corona discharge is produced between each wire 3 and the respective electrode 1 upon application of the voltage therebetween, thereby charging kinetic energy to neutral gas molecules to generate an air stream directed from the wires 3 toward the interval between the respective electrodes when ions are moved to the side of the electrodes 1. Further, when the air stream is produced, fine particles in the air charged in ions are collected on the dust collecting electrodes 1. Moreover, remaining fine particles which have not been completely collected are collected on the electrodes 1 by means of an electric field formed between the electrodes 2 and 1 in the course of the air flowing in the interval. In case that the voltage supplied from the power source 4 has a constant value, the force for producing an air stream in parallel with the panel surface of the electrodes 1 in the interval is, as shown in FIG. 1, given by the component force F cos $\theta$ of the force F directed from the wire 3 to the electrode 1, where $\theta$ is an opening angle from the wire 3 as an origin between the end of the electrode 1 and the end of the electrode 2. When the distance r has reached 0 in this case, the angle $\theta$ approaches 90° and accordingly the force F cos $\theta$ approaches 0. Thus, the force for producing the air stream is almost vanished. When the distance r is, on the other hand, increased, a magnetic field between the end of the wire 3 and the end of the electrode 1 decreases proportionally to $1/r^2$, thereby remarkably weakening the corona discharge electric field. Thus, similarly to the above, the air stream almost stops. Accordingly, when the power source voltage is constant, an adequate value exists in the set range of the distance r, thereby defining the velocity of the air stream to be produced substantially to a predetermined value.

However, in such a conventional air cleaner, the dust collecting efficiency is insufficient in practical use due to the long interval of approx. 10 mm between the dust collecting electrode and the corresponding electrode. In addition, since no means is provided against a zone generated by corona discharge, the zone flow rate out of the air cleaner can amount to approx. 200 ppb, which may influence a human body.

The volume and the cleaning efficiency of a chamber to be cleaned by an air cleaner are different depending upon the purpose of using the chamber. Thus, the air cleaner requires the corresponding performance. However, in the conventional air cleaner, the velocity of the air stream to be produced is defined substantially by a predetermined value when the voltage of the power source is defined by a constant value. Therefore, the conventional air cleaner has drawbacks and does not sufficiently meet the above-described requirements.

SUMMARY OF THE INVENTION

It is an object of this invention to provide an air cleaning apparatus which is capable of improving dust collecting efficiency and reducing ozone flow rate.

It is another object of this invention to provide an air cleaning apparatus which has large processing capacity.

In order to achieve the above first object, there is provided according to this invention a cleaning apparatus which comprises a plurality of dust collecting panel electrodes and corresponding panel electrodes arranged, respectively oppositely to each other at a predetermined interval to form air flow passages in a casing having an air flow inlet and an outlet, and a number of ionizing wires installed at a predetermined distance from the ends of the dust collecting panel electrodes substantially on extension lines extended from the respective corresponding electrodes outwardly from the intervals. Further, the dust collecting panel electrodes, and the corresponding panel electrodes and the ionizing wires may be provided at narrow intervals so that the corresponding panel electrodes and the ionizing wires of equal polarity to that of the dust collecting panel electrodes, the voltage applied between the dust collecting panel electrodes and the corresponding panel electrodes being set to substantially one-second of that applied between the dust collecting panel electrodes and the ionizing wires, and the length of the intervals between the dust collecting panel electrodes and the corresponding panel electrodes being of a predetermined potential gradient in response to the applied voltage value. In addition, ozone decomposing accelerating noble metal plating layer is coated on each of the dust collecting panel electrodes and the corresponding panel electrodes, and an ozone decomposing filter formed of activated coal being arranged at the air flow outlet. This air cleaning apparatus of the invention can thus improve the dust collecting efficiency a sufficient degree in practical use and can reduce the ozone flow rate.

In order to achieve the second object, there is provided according to the invention an air cleaning apparatus which further comprises a second group of ionizing wires installed at a predetermined distance from the first group of ionizing wires substantially on extension lines of the respective dust collecting panel electrodes at the position further remote from the first group of ionizing wires, thereby generating a corona discharge between the first and the second groups of ionizing wires to accelerate the produced air stream. With this structure, the velocity of the air stream can be accelerated (air flow rate per unit time), thereby remarkably improving the air cleaning efficiency.

The above and other objects and features of the present invention will becomes apparent from a reading of the following description with reference to the accompanying drawings.

DETAILED DESCRIPTION OF THE PREFERRED EMBODIMENTS

Figure 1:
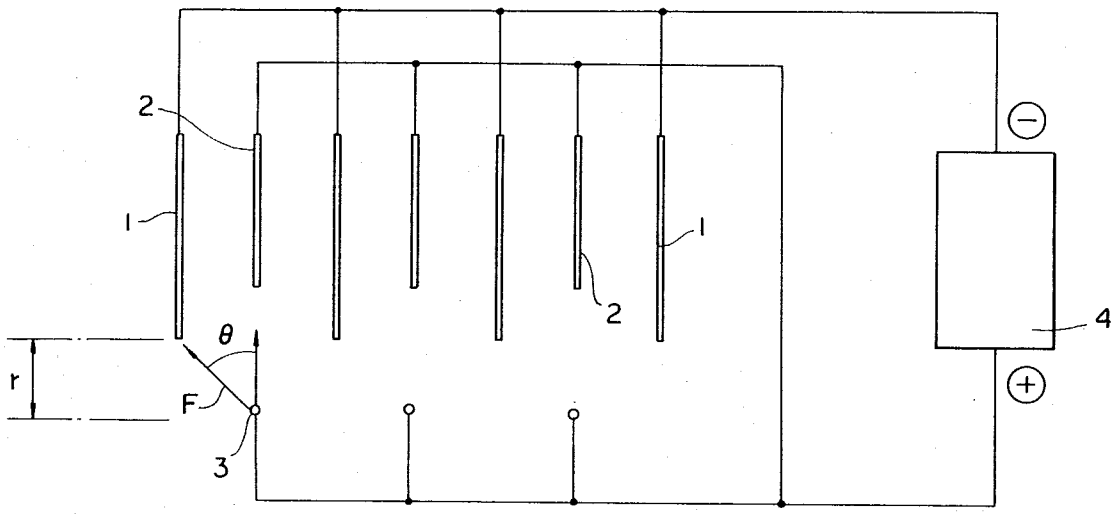
FIG. 1 PRIOR ART
FIG. 1 is a plan view schematically showing a conventional air cleaner.
Figure 2:
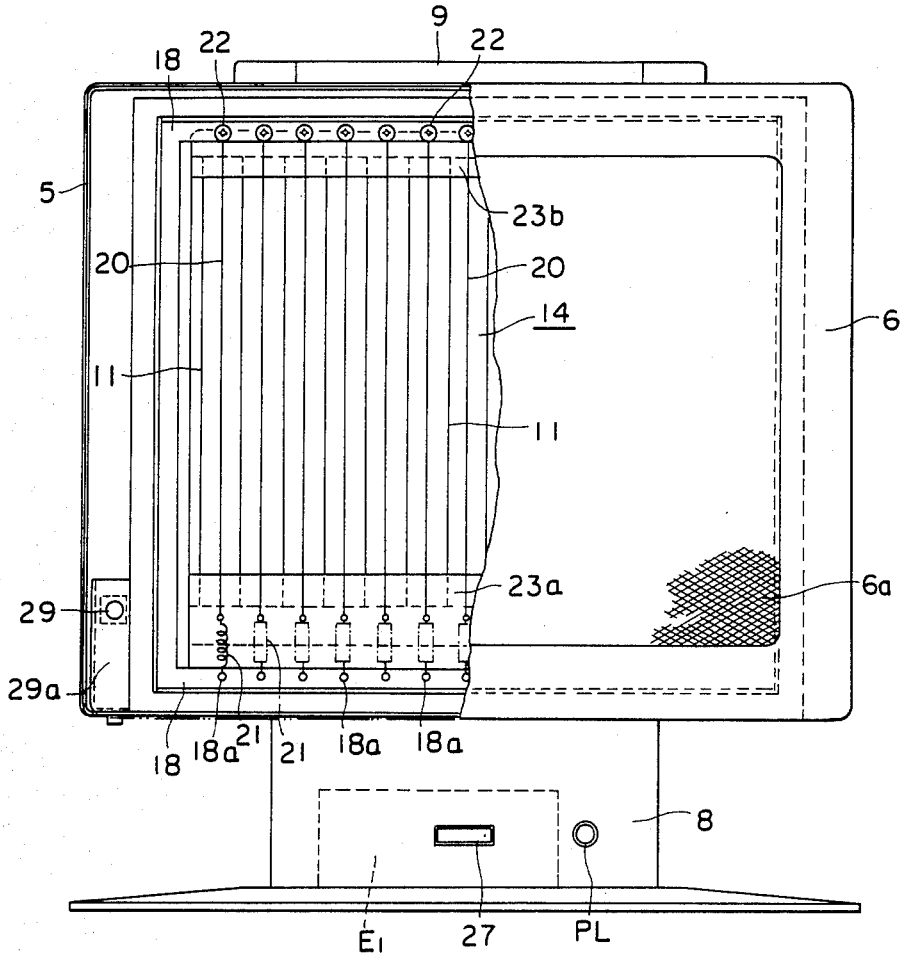
FIG. 2 is a partially fragmentary front view of a preferred embodiment of an air cleaning apparatus according to the present invention.
Figure 3:
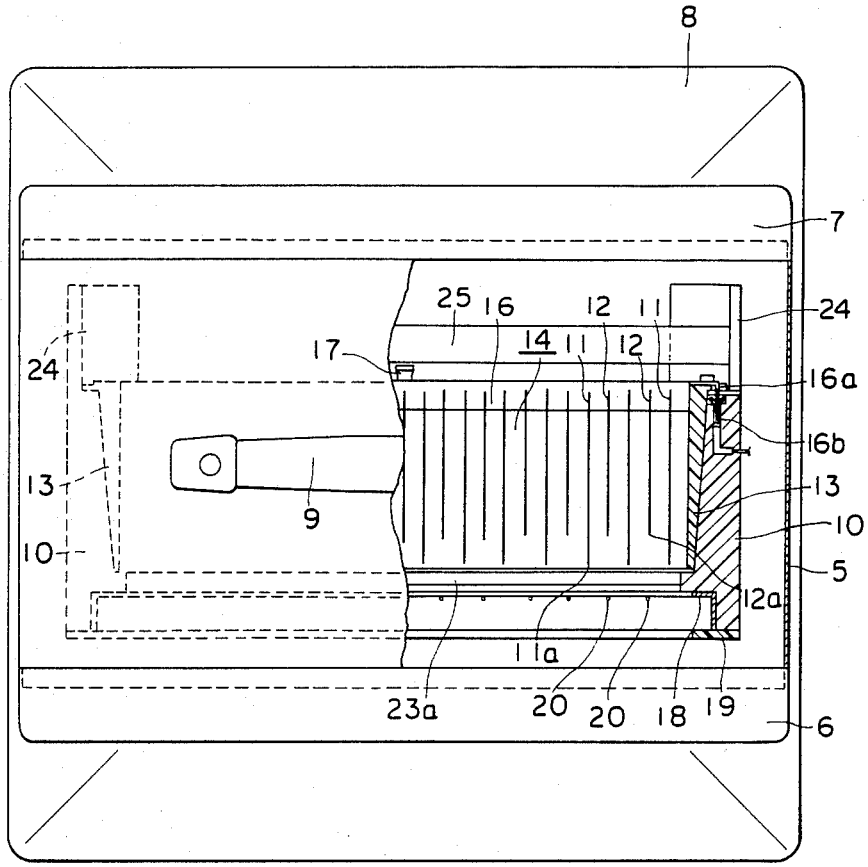
FIG. 3 is a partially fragmentary plan view of the apparatus in FIG. 2.
Figure 4:
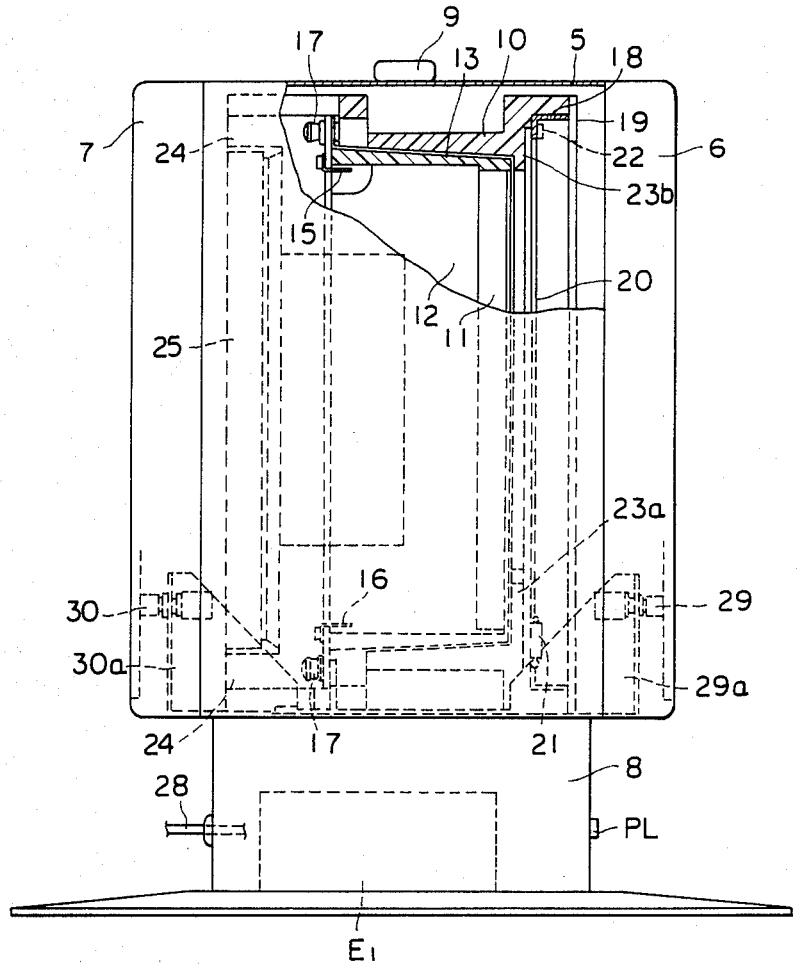
FIG. 4 is a partially fragmentary side view of the apparatus in FIG. 2.
Figure 5:
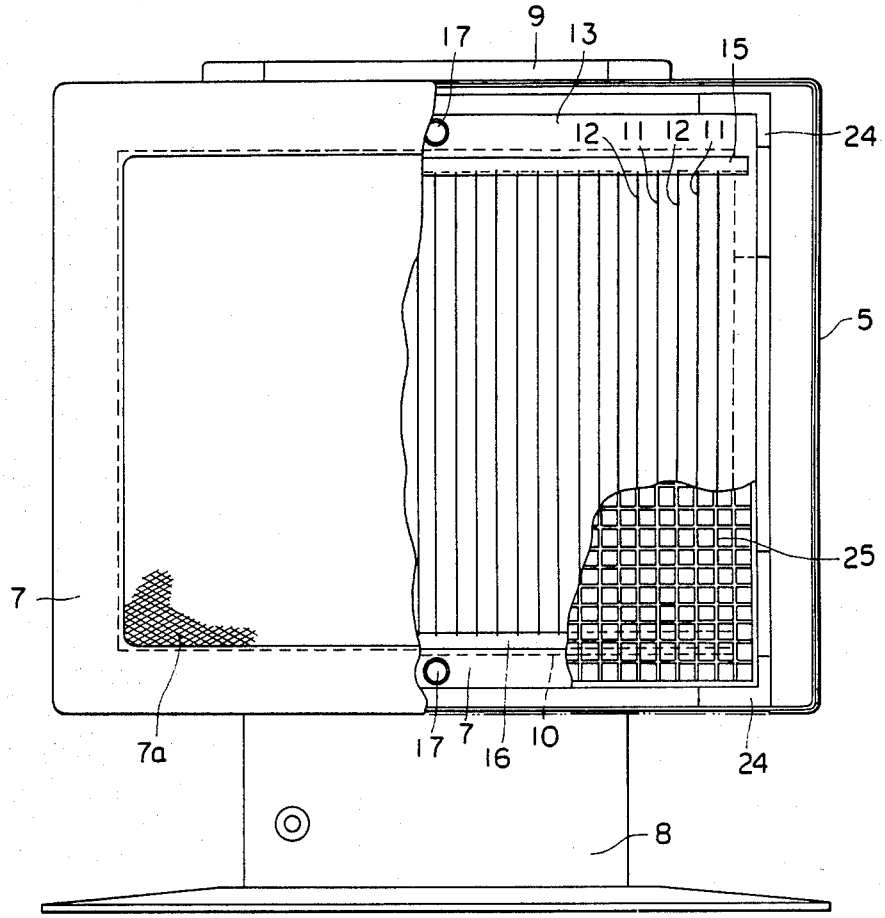
FIG. 5 is a partially fragmentary back view of the apparatus in FIG. 2.

The present invention will be described in more detail with reference to accompanying drawings. FIGS. 2 to 6 show a typical embodiment of an air cleaning apparatus according to the present invention. In FIGS. 2 to 4, reference numeral 5 designates a casing, in which inlet and outlet side mask frames 6 and 7 respectively having mask nets 6*a* and 7*a* are detachably mounted to form an air flow inlet and an air flow outlet at left-hand and right-hand sides of the device. A stand 8 is mounted at the lower portion of the casing 5, and a handle 9 is mounted on the top of the casing 5.

Said casing 5 has therein units which have respective ionizing function, dust collecting function and ozone decomposing function, and a containing frame 10 for holding the units. More particularly, as shown in FIG. 3, a unit containing frame 10 is fixedly secured substantially to the center of the casing 5, and a dust collecting unit frame 13 is detachably mounted on the frame 10. The frame 13 has a plurality of dust collecting panel electrodes 11 and corresponding panel electrodes 12 alternately arranged oppositely to each other at predetermined intervals 14. The intervals 14 form air flow passages, which are maintained, for example, at approx. 5 mm. The electrodes 11 and 12 are formed of substrates such as metal plates made of brass or copper, and are treated with ozone decomposition accelerating silver plating layers. The metal for accelerating the ozone decomposition may include, for example, not only silver, but also such noble metals as gold, or platinum. Each of the electrodes 12 is formed narrower in width and shorter in length than each electrode 11, and is, as shown in FIG. 3, disposed inside the interval between electrodes 11 and spaced by a predetermined distance from the line connecting the edges 11*a* of the electrodes 11. A pair of terminal boards 15 and 16 are bonded, as shown in FIG. 4, on the inner surfaces of the respective electrodes in the vicinity of the rear edge of the frame 13 (In the description, the front and the rear define the air flow inlet side and outlet side, respectively.) The electrodes 11 are commonly connected to the upper board 15, and the electrodes 12 are commonly connected to the lower board 16. Reference numeral 16*a* designates a plug socket, and reference numeral 16*b* designates a terminal receptacle, and the board 15 also has similarly a plug socket and a terminal receptacle (not shown). Thus, the electrodes 11 and 12 are respectively connected to a power source $E_1$ through the plug socket and the terminal receptacle as will be described with reference to FIG. 6. The frame 13 is formed, as shown in FIG. 3, with tapered surfaces on the four outer peripheral faces. The inner surfaces of the frame 10 are also formed with the respective tapered surfaces corresponding to the tapered surfaces of the frame 13, which is detachable at the rear side from the frame 10. Reference numerals 17 denote latches, and the frame 13 is anchored by the latches 17 in the inserted position. The electrodes 11 and 12 are insertable into or releasable from the casing 5 by the insertion or removal of the frame 13.

The frame 10 has a slightly expanded portion at the front side. An ionizing unit frame 18 formed of metal is engaged with that expanded portion (FIGS. 3 and 4). Reference numeral 19 illustrates an ionizing unit retaining frame, and the frame 18 is secured fixedly by the frame 19 in the engaged position. Ionizing wires 20 are installed between the upper and lower beams of the frame 18. The wires 20 are formed of tungsten wires having approx. 1 mil of thickness, and are treated with noble metal plating layer of gold similarly to the above. Each wire 20 has a coil spring 21 elastically extended at the lower portion thereof. The lower end of each spring 21 is engaged with a hole 18*a* provided in the frame 18, and the upper end of each wire 20 is engaged fixedly by a screw 22 with the frame 18. The wire 20 is defined in the position spaced at a predetermined distance such as, for example, approx. 20 mm from a line for connecting the front edges 11*a* of the electrodes 11 on the front extension line of the respective electrodes 12. The position of the wire can be readily defined by elastically engaging the spring 21. Each wire 20 is connected to the power source $E_1$ via a lead wire (not shown) led from the frame 18.

Shielding plates 23*a* and 23*b* formed of plastic preventing ozone flow are mounted at a predetermined height in the vicinity of the installing ends of the wires 20 and the electrodes 11 and 12.

On the other hand, filter frame mounts 24 are extended from four rear corners of the frame 10, and an ozone decomposing filter 25 is engaged with the mounts 24. The filter 25 is formed of activated coal, which is pulverized in mesh of approx. 12 cells/square inch, thereby enhancing the ozone decomposing function.

Figure 6:
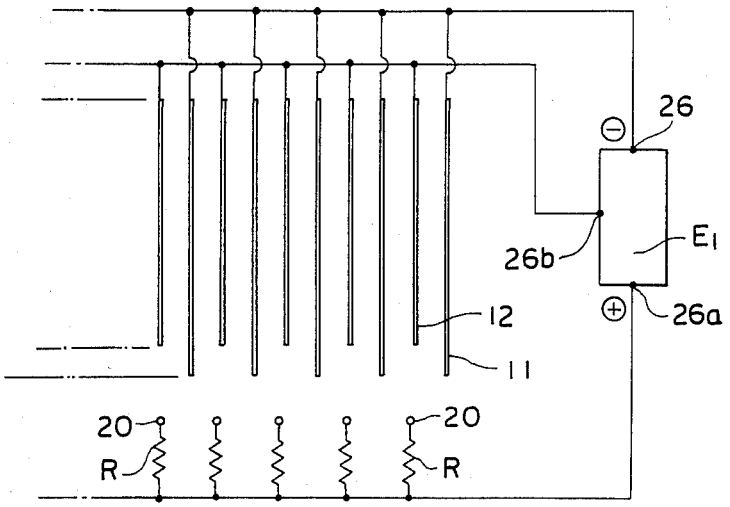
FIG. 6 is a circuit diagram showing the connecting relation between ionizing wires, dust collecting panel electrodes and a power source.

FIG. 6 shows the connections of the electrodes 11 and 12 and the power source $E_1$. The electrodes 11 are connected to a terminal 26 of negative polarity. The wires 20 and the electrodes 12 are connected to positive polarity, and the wires 20 are connected through discharge current regulating resistors R to the positive terminal 26*a*, and the electrodes 12 are connected to an intermediate terminal 26*b* of $\frac{1}{2}$ voltage point. The voltage value at the terminal 26*a* is, for example, 15 kV. In this connection state, +15 kV is applied to the wires 20 with respect to the electrodes 11, and +7.5 kV of $\frac{1}{2}$ voltage is applied to the electrode 12. The length of the interval between the electrodes 12 and 11 is approximately 5 mm to maintain a predetermined potential gradient, approx. 1.5 kV/mm corresponding to $\frac{1}{2}$ of the applied voltage value.

In FIGS. 2 and 4, reference numeral 27 designates a power switch, 28 is a power cord, PL is a pilot lamp, 29 and 30 are safety limit switches, and 29*a* and 30*a* are limit switch mounting brackets. The switches 29 and 30 are composed of normally closed contacts connected in series with the switch 27 and switched to OFF when the inlet or outlet side mask 6 or 7 is removed, thereby preventing the high voltage from contacting a hand.

The operation of the above embodiment of the air cleaning apparatus will be described below.

The air cleaning apparatus is installed in a predetermined position in a room. When the switch 27 is closed ON, with the electrodes 11 in negative polarity 15 kV is applied between the electrodes 11 and the wires 20, and 7.5 kV of ½ equal to 15 kV is applied between the electrodes 11 and 12. Corona discharges are produced by the 15 kV applied between the wires 20 and the electrodes 11. When the numerous ions are moved by the corona discharges to sides of electrodes 11, their kinetic energy is applied to neutral gas molecules, and an air stream is generated which flows toward an interval 14 at a predetermined velocity, such as approximately 60 m/min. Simultaneously, impurity particles in the air are charged in the ions and collected on the electrodes 11. On the other hand, since 7.5 kV is also applied through an interval 14 between the electrodes 11 and 12, the remaining particles which are not collected by the previous corona discharge of the impurity particles in the air are attracted to the electrodes 11 and are collected. In the present invention, the length of an interval 14 is as narrow as 5 mm. Accordingly, the probability of collecting impurity particles in the course of passing through an interval 14 is increased and the dust collection effect is enhanced. The measured example of the efficiency is shown as below:

| Impurity particles (μ) | Dust collecting efficiency (%) |
|---|---|
| 0.3 | 98.70 |
| 0.5 | 99.59 |
| 1.0 | 99.99 |

The dust collecting efficiency of the conventional air cleaner of electrostatic type is normally approx. 50%.

A large quantity of ozone is produced during the corona discharge with the high electric field. However, the ozone contacts the silver plating layer coated on the electrodes 11 and 12 in the course of flowing along an interval 14 and is decomposed to oxygen molecules. Since the electric field is concentrated in the vicinity of the ends of the wires 20, the quantity of produced ozone at this part tends to increase as compared with the other part. Since the plates 23*a* and 23*b* are however located at this part, the corona discharge is disturbed by the plates, thereby suppressing the production of the ozone in this part. The quantity of the produced ozone can be reduced to approximately 20 ppb or approximately 1/10 of a conventional precipitator by employing the ozone decomposition of the silver plating layer and the ozone production preventing operation of the plates 23*a* and 23*b*. The ozone thus reduced is further decomposed in contact with the ozone decomposing filter 25 of activated coal in the course of flowing out from the outlet side. Since the filter 25 has a mesh of 12 cells/square inch, the flowing ozone can be progressively decomposed effectively in contact with the surface of the activated coal, and can be further reduced. The degree of decomposing the ozone by the filter 25 depends upon the quantity of the ozone flowed to the filter, but 25 to 40% of the ozone is decomposed by the filter. If the filter 25 is inactivated as it is used, it is necessary to suitably exchange the filter, but since the filter 25 in this invention is formed of activated coal, its lifetime is maintained over one year.

As described above, the noble metal plating layers coated on the plates 23*a* and 23*b*, and the electrodes 11 and 12 as well as the filter 25 cooperate to suppress the production of ozone or to effectively decompose the ozone so as to remarkably reduce the ozone less than the stipulated quantity so as not endanger a human body.

As the progressive use, impurity particles in the air are adhered to the wires 20, resulting in extension of the side of particles in stylus state to the electrodes 11. The variation in the electric field occurs between the wires 20 and the electrodes 11 due to the adherence of the particles in the stylus state to the wires 20, and a trend of generating a self-exciting vibration noise takes place at the wires 20. Since the spring 21 is installed elastically at the wires 20, it can alleviate the vibration, thereby reducing the production of the noise.

Figure 7:
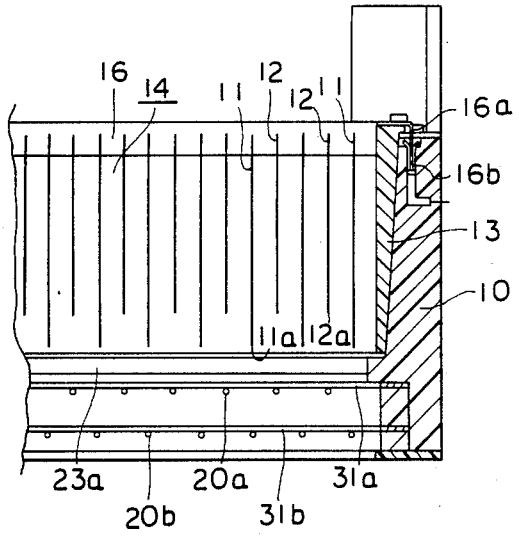
FIG. 7 is a plan view of the essential part of another embodiment.
Figure 8:
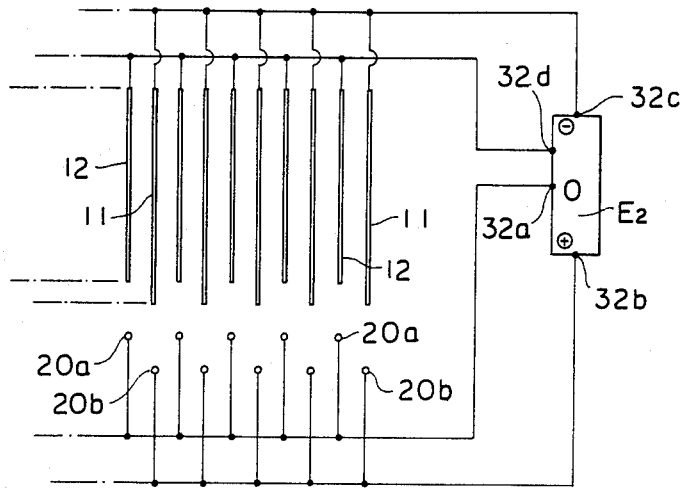
FIG. 8 is a circuit diagram showing the connecting relation between the first and second groups of ionizing wires and the panel electrodes and the power source in the apparatus in FIG. 7.
Figure 9:
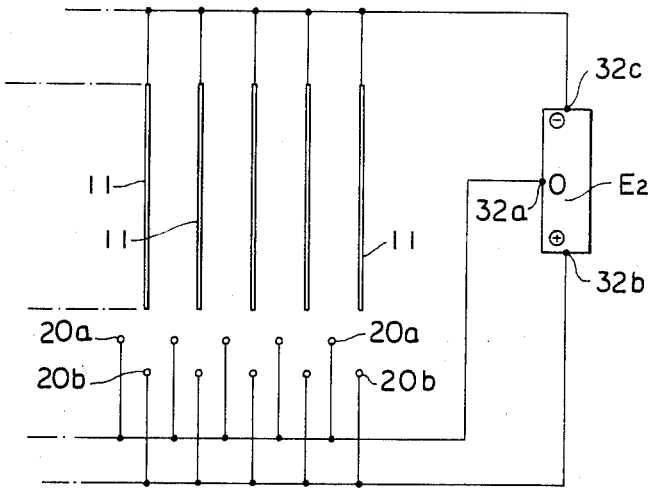
FIG. 9 is a circuit diagram showing the connecting relation between the panel electrodes and the power source in a modified embodiment of the invention.

Further, the impurity particles in the air are accumulated on the electrodes 11 due to the above described effective dust collecting operation. Accordingly, it is necessary to clean the electrodes 11. At this time, the electrodes 11 and 12 are removed from the casing 5 together with the frame 13 and are cleaned. Then, in FIGS. 7 to 9, other preferred embodiments of the air cleaning apparatus according to the invention is shown. In FIGS. 7 to 9, the members or those equal or equivalent to those members in FIGS. 2 to 6 are designated by the same reference numerals and will not accordingly be described but will be omitted.

In the embodiment shown in FIGS. 7 and 8, a second group of ionizing wires 20*b* are installed at a predetermined distance from the first group of ionizing wires 20*a* substantially on extension lines extended from the respective electrodes 11 and outwardly from the first group of the wires 20*a*. Corona discharges are also produced between the wires 20*a* and the wires 20*b*.

This arrangement will be further described in more detail. First and second ionizing unit frames 31*a* and 31*b* formed of metal are, for example, engaged fixedly at a predetermined interval such as approx. 13 mm from each other at the inlet-side expanded part of the unit containing frame 10. The first group of ionizing wires 20*a* are installed between the upper and the lower beams of the frame 31*a*, and the second group of ionizing wires 20*b* are installed between the upper and the lower beams of the second ionizing unit frame 31*b*. Both groups of the wires 20*a* and 20*b* are constructed similarly to those in the first embodiment at the points that the ozone decomposition accelerating noble metal plating layers are provided and that the coil springs are mounted at the lower parts. With this installing state, the first group of ionizing wires 20*a* are defined in the position spaced at a predetermined distance, such as, for example, 13 mm from the line connecting the edges 11*a* of the respective wires 11 on the front extension lines extended from the respective electrodes 12. Further, the second group of ionizing wires 20*b* are installed in the position spaced at a predetermined distance such as, for example, 13 mm from the line connecting the respective wires 20*a* on the extension lines extended from the respective electrodes 11 outwardly from the row of the wires 20*a*. In the invention, the first and second groups of wires 20*a* and 20*b* are arranged in two stages. When the wire groups 20*a* and 20*b* are provided with the elastical coil spring, the wires can be readily defined in the position to be installed. The wire groups 20*a* and 20*b* are respectively connected to the terminals of a power source $E_2$, which will be described later, via lead wires (not shown) led from the frames 31*a* and 31*b*.

FIG. 8 shows the connections of the electrodes 11 and 12, the wire groups 20*a* and 20*b* and the power source $E_2$. The wires 20*a* are connected to a 0 volt terminal 32*a*, the wires 20*b* are connected to the positive V terminal 32*b*, the electrodes 11 are connected to the negative V terminal 32*c*, and the electrodes 12 are connected to the negative $\frac{1}{2}$ V terminal 32*d*. The voltage value V is, for example, 12.5 kV. Accordingly, with the group of electrodes 11 as reference, the wires 20*a* are applied with positive 12.5 kV, the electrodes 12 are applied with positive 6.25 kV equal to $\frac{1}{2}$ of the 12.5 kV, and the wires 20*b* are applied with positive 25 kV. A predetermined discharge voltage of 12.5 kV is applied between the electrodes 11 and the wires 20*a* and between the wires 20*a* and the wires 20*b*. On the other hand, the length of the interval between the electrodes 11 and 12 is slightly longer than 4 mm corresponding to the applied voltage value of the 178 so as to set a predetermined potential gradient of approx. 1.5 kV/mm.

The operation of this embodiment will be described below. When the power switch (not shown) is closed ON, 12.5 kV is applied between the electrodes 11 and the wires 20*a* and between the wires 20*a* and the wires 20*b*, thereby producing corona discharges therebetween. When numerous ions move with the corona discharges toward the wires 20*a* and the sides of electrodes 11, their kinetic energy is applied to the neutral gas molecules, thereby producing a gas stream. Thus, an air stream is produced at a predetermined velocity from the wires 20*a* and 20*b* toward the interval side. In this embodiment, the discharge sections are formed in two stages. Then, the initial flow produced by the corona discharge of the first stage between the wires 20*a* and 20*b* is accelerated by the corona discharge of the second stage between the wires 20*a* and the electrodes 11, providing the air stream having a velocity which reaches approximately 85 m/min. This velocity is accelerated by approximately 40% as compared with that of the first embodiment. As this air stream is produced, impurity particles in the air are charged to the ions and are collected to the electrodes 11. On the other hand, a voltage of 6.25 kV is applied through the interval between the electrodes 11 and 12. Accordingly, the remaining particles not collected by the corona discharge of the particles in the air stream are attracted to the electrodes 11 by the electric field produced in this manner and are collected. This particle collecting operation is formed in a narrow width such as, for example, approximately 4 mm within the length of the interval. Even if the velocity is accelerated, this operation can be remarkably effectively performed.

In FIG. 9. a modified example of the panel electrode arrangement in the above described second embodiment is shown. In this modified example, the arrangement of the corresponding panel electrodes is omitted as compared with that of FIGS. 7 and 8. According to this modified example, since no arrangement of the corresponding panel electrodes exists, the velocity of the air stream flowing in the interval, and hence the point of air flow rate, can be further accelerated.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An air cleaning apparatus, comprising a casing having an air flow inlet and air flow outlet, a plurality of dust collecting panel electrodes arranged in parallel and spaced from each other at predetermined intervals to form air flow passages therebetween, said electrodes having ends, a first group of ionizing wires arranged at a first predetermined distance from said ends and extended along imaginary lines projecting intermediate said intervals and away from said intervals; a second group of ionizing wires positioned at a greater predetermined distance from said ends than that of said first group, the ionizing wires of the second group extending substantially along imaginary extension lines projecting from the respective dust collecting electrodes; a voltage source connected to said dust collecting electrodes and said first and second group of ionizing wires such that said first group and said second group of the ionizing wires are of one and the same polarity and said dust collecting electrodes are of the opposite polarity, said voltage source being constructed so as to apply between said dust collecting electrodes and said first and second second group of ionizing wires a voltage so that corona discharges are produced between said dust collecting electrodes and said first group of ionizing wires and between said first group of ionizing wires and said second group of ionizing wires and an air stream is generated at each of said intervals by the corona discharges, and a predetermined potential gradient is produced between respective dust collecting electrodes; connecting means for connecting said voltage source to said first and second group of ionizing wires so as to apply between said dust collecting panel electrodes and said first group a voltage value of substantially $\frac{1}{2}$ of the voltage value applied between said dust collecting electrodes and said second group of ionizing wires, said dust collecting panel electrodes being each coated with an ozone decomposion-accelerating noble metal plating layer; ozone insulating plates mounted at said inlet and at ends of said ionizing wires and said dust collecting electrodes so as to prevent ozone generation thereon; and an ozone decompositing activated coal filter arranged at said air flow outlet.

2. An air cleaning apparatus, comprising a casing having an air flow inlet and an air flow outlet; a plurality of dust collecting electrodes having ends and a plurality of corresponding panel electrodes disposed in said casing, said dust collecting electrodes and said corresponding panel electrodes being arranged in a row alternatively and in parallel with each other and one oppositely to another and being spaced from each other at predetermined intervals to form air flow passages therebetween; a first group of parallel ionizing wires mounted in said casing and arranged at a first predetermined distance from said ends and extended along imaginary extension lines projecting from said panel electrodes; a second group of parallel ionizing wires mounted in said housing and positioned at a greater predetermined distance from said ends than that of said first group in the direction away from said ends, said ionizing wires of the second group extending substantially along imaginary extension lines projecting from the dust collecting electrodes; a voltage source connected to said dust collecting electrodes, said panel electrodes, and said first and second group of ionizing wires so that said first group and said second group of the ionizing wires and said corresponding electrodes are of one and the same polarity and said dust collecting electrodes and said panel electrodes are of the opposite polarity, said voltage source being constructed so as to apply between said dust collecting electrodes and said second group of ionizing wires a first voltage value and between said dust collecting electrodes and said first group of ionizing wires a second voltage value so that the first voltage value is higher than the second voltage value, whereby corona discharges are produced between said dust collecting electrodes and said first group of ionizing wires and between said first group of ionizing wires and said second group of ionizing wires and an air stream is generated at each of said intervals by the corona discharges, and a predetermined potential gradient is produced between the respective dust collecting electrodes and the corresponding panel electrodes; connecting means for connecting said voltage source to said dust collecting electrodes and to said panel electrodes so as to apply between said dust collecting electrodes and said corresponding panel electrodes a voltage value of substantially ½ of the voltage value applied between said dust collecting electrodes and said first group of ionizing wires, said dust collecting electrodes and said corresponding panel electrodes being each coated with an ozone decomposion-accelerating noble metal plating layer; ozone insulating shielding plates mounted at said flow inlet and at ends of said ionizing wires, said dust collecting electrodes and said corresponding panel electrodes so as to prevent ozone generation thereon; and an ozone decompositing activated coal filter arranged at said air flow outlet.

* * * * *